US006311793B1

(12) United States Patent
Larsen et al.

(10) Patent No.: US 6,311,793 B1
(45) Date of Patent: Nov. 6, 2001

(54) ROCK BIT NOZZLE AND RETAINER ASSEMBLY

(75) Inventors: James L. Larsen, Spring; Michael A. Siracki, The Woodlands, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/266,567

(22) Filed: Mar. 11, 1999

(51) Int. Cl.[7] ..... E21B 10/18
(52) U.S. Cl. ..... 175/340; 175/393
(58) Field of Search ..... 175/339, 340, 175/393, 417, 418, 429

(56) References Cited

U.S. PATENT DOCUMENTS 4,567,954 * 2/1986 Voight, III et al. ..... 175/424
4,687,067 * 8/1987 Smith et al. ..... 175/340
4,776,412 * 10/1988 Thompson ..... 175/393
4,784,231 * 11/1988 Higgins ..... 175/340
5,494,122 * 2/1996 Larsen et al. ..... 175/340
5,494,124 * 2/1996 Dove et al. ..... 175/424
5,538,093 * 7/1996 Siracki et al. ..... 175/393
5,632,349 * 5/1997 Dove et al. ..... 175/393
5,653,293 * 8/1997 Dove et al. ..... 175/67
5,669,459 * 9/1997 Larsen et al. ..... 175/340
5,967,244 * 10/1999 Arfele ..... 175/340
5,992,763 * 11/1999 Smith et al. ..... 239/428.5
6,029,756 * 2/2000 Britzke et al. ..... 175/57

* cited by examiner

*Primary Examiner*—David Bagnell
*Assistant Examiner*—Jennifer Dougherty
(74) *Attorney, Agent, or Firm*—Wesley T. Noah

(57) ABSTRACT

A nozzle and retainer assembly is provided for use in a rotary cone earth boring bit that allows for a larger internal passage in the nozzle. In one aspect, the assembly has a nozzle seated on a shoulder in a receptacle with a stepped portion extending radially outward with a first nozzle shoulder spaced from and facing toward the shoulder in the receptacle to partially define a seal gland. The stepped portion has a second nozzle shoulder facing toward the open end of the receptacle and the retainer engages the inside surface of the receptacle and the second nozzle shoulder to retain the nozzle in the receptacle.

54 Claims, 13 Drawing Sheets

ROCK BIT NOZZLE AND RETAINER ASSEMBLY

TECHNICAL FIELD OF THE INVENTION

The present invention relates to a nozzle and retainer assembly for use in rotary cone earth boring bits. In one aspect, the present invention relates to a nozzle and retainer assembly that allows for a larger fluid passage in the nozzle and for orientation of the nozzle relative to the bit.

BACKGROUND OF THE INVENTION

Earth boring bits used for drilling holes in the earth are typically classified into two types: drag bits which have no moving parts and shear the formation (e.g. polycrystalline diamond compact (PDC) bits, diamond impregnated bits, etc.) and rotary cone bits which have one or more generally conic roller cones rotatably mounted on the bit body. The roller cones have cutting teeth and/or inserts extending therefrom and rotation of the bit body rotates the cones so that the cutting teeth and/or inserts crush and gouge the formation.

Both of these types of bits use nozzles mounted on the bit body to direct drilling fluid coming down the drill string to sweep the bottom of the borehole and carry cuttings back up the hole on the outside of the drill string. This fluid flow, or "bit hydraulics", serves three primary purposes: cutting removal, relief of chip hold down pressure, and, in the case of rotary cone bits, cleaning of the cones. The location and type of the nozzles used can greatly impact these purposes.

Location of the nozzles relative to the borehole bottom is especially relevant to rotary cone bits versus drag bits. Because the face of the drag bit body is directly against the formation, the nozzles in a drag bit are readily located near the borehole bottom by mounting of a nozzle in a receptacle in the bit body. In contrast, the bit body of a rotary cone bit is disposed above the bottom of the formation by the rotary cones and thus fluid exiting from a nozzle recessed or flush with the bit body must travel a significant distance before impinging at or near the borehole bottom. Moving the nozzle exit closer to the hole bottom can generally improve chip removal by increasing the bottom hole energy and by improving the ability of the fluid to relieve chip hold-down pressures.

One way the exit orifice of nozzles in rotary cone bits have been moved closer to the borehole bottom is by using steel tubes that extend from the bit body with a wear-resistant nozzle mounted in the end of the tube. These extended nozzle tubes have the advantage of being able to closely locate the exit orifice of the nozzle close to the borehole bottom; however, the extended tubes are susceptible to breaking. A tube breaking off of the bit effectively ends the run of that particular bit and may require a costly down hole fishing (retrieving) operation to remove the tube from the bottom of the borehole.

Another way that the exit orifice has been moved closer to the borehole bottom is by the use of "mini-extended" nozzles. Conventional nozzles are generally flush or recessed from the outer surface of the receptacle in the bit body in which they are mounted. Mini-extended nozzles have a portion which extends beyond the receptacle in which it is mounted but still are retained by conventional nozzle retention means. With reference to FIG. 1, a conventional mini-extended nozzle 10 is shown mounted in receptacle 12 defined in bit body assembly 14 with fluid bore 15. Nozzle 10 defines passage 16 for the direction of drilling fluid through the nozzle. Receptacle 12 conventionally has a standard inner diameter for a given size bit. Retainer 18 threads into receptacle 12 at threaded connection 24 and retains nozzle 10 in receptacle 12 by capturing shoulder 20 of nozzle 10 by ledge 22 extending radially inward from retainer 18. Nozzle 10 seats on shoulder 26 in receptacle 12. Seal 28 seals between the outer surface of nozzle 10 and the inside of receptacle 12. Nozzle 10 is referred to as a "mini-extended" nozzle due to the fact that the nozzle has portion 11 extending beyond receptacle 12. The outer diameter of portion 11 is smaller than the outer diameter of base portion 13 of nozzle 10 in order to extend beyond ledge 22 of retainer 18. The advantage of mini-extended nozzles is their relative durability and ruggedness compared to extended tubes; however, a mini-extended nozzle does not locate the nozzle orifice as close to the borehole bottom as an extended tube.

U.S. Pat. No. 5,669,459 discloses a retention body for holding a mini-extended nozzle closer to the borehole bottom. This design has the advantage of better protecting the mini-extended nozzle during operation by extending a mild steel retention body along the portion of the nozzle that extends beyond the body of the bit. By better protecting the nozzle, the orifice of the nozzle can be moved closer to the borehole bottom compared to a mini-extended nozzle mounted in a conventional receptacle while at the same time avoiding the potential breakage problems associated with extended tubes.

Thus for a rotary cone bit, the mini-extended nozzle can be used in a conventional receptacle for some extension, with a retention body of the '459 patent for additional extension, or with an extended tube for even more extension but with risk of tube breakage.

In addition to location of the nozzle in the axial direction (i.e., distance from borehole bottom), the type of nozzle used impacts the goals of chip removal, relief of chip hold down pressure, and cone cleaning. More specifically, the nozzle passageway and orifice can effect bit hydraulics. U.S. Pat. No. 5,494,124 (as well as related patents U.S. Pat. Nos. 5,632,349; and 5,653,298) discloses a type of nozzle with a passageway and orifice design that is purported to provide advantages over other nozzles when used in an earth boring bit. FIGS. 1, 3, and 5 of the '124 patent show the shaped orifices (slot 16, 46, and 76, respectively) while FIGS. 2, 4, and 6 of the '124 patent show the corresponding internal passage 20, 50, 80, respectively.

With reference to FIG. 2, an embodiment of nozzle 10' of the type disclosed in the '124 patent is shown in receptacle 12 with retainer 18 capturing end 21 of nozzle 10'. Nozzle 10' is recessed from the opening of receptacle 12. Passage 16' has transition zone 29 that transitions from passage 16' to orifice 31. The '124 patent teaches particular shapes of transition zone 29 and orifice 31 to achieve the desired fluid characteristics for the nozzle.

One disadvantage of the nozzle of the '124 patent is that its internal passage 16' must be much larger than that of a conventional nozzle to allow sufficient room for the desired short transition zone 29 with its high rate of inward taper to orifice 31, especially for larger sized nozzle orifices. The standard receptacle 12 in a bit together with the retention means used to hold the nozzle in the receptacle limits the maximum outer envelope of the nozzle, and this together with the minimum acceptable wall thickness of the nozzle limits the maximum size of internal passage 16' of the nozzle. Thus, for a given receptacle 12, the maximum nozzle orifice size achievable by the '124 nozzle will be appreciably less than that of a conventional nozzle. This is a disadvantage because standard drilling practices often require larger nozzle orifices to reduce the pressure drop across the bit. The inability to accommodate larger nozzle orifices makes the nozzles of the '124 patent less versatile and unable to be used in certain drilling applications that may require a pressure drop that is less than that available with the largest '124 nozzle for the particular receptacle in the bit.

This disadvantage of the '124 nozzle is compounded when it is desired to take advantage of the mini-extended nozzle concept by extending the end of the nozzle beyond the receptacle in which it is mounted. Retainer 18 used with mini-extended nozzle 10 in FIG. 1 requires a reduced outer diameter of extended portion 11. This reduced diameter even more severely restricts the maximum size of internal passage 16' of the '124 type nozzle of FIG. 2 thus further reducing the maximum nozzle exit orifice size possible relative to a mini-extended nozzle with a conventional internal passage.

Furthermore, the nozzle of the '124 patent relies in part on a relatively short transition zone 29 to taper from passageway 16' to orifice 31. Passageway 16' only slightly tapers radially inward from interior end 19 to transition zone 29 and thus maintains a relatively large inner diameter compared to passageway 16 in FIG. 1. Transferring passageway 16' to a mini-extended nozzle of FIG. 1 can be seen by the dashed line in FIG. 1 which represents extended passageway 16" for a nozzle of the type of the '124 patent. As can be seen the inner diameter of passageway 16" is larger than the outer diameter of extended portion 11 at a point indicated at 17. Thus, such an extension is not possible with retainer 18 of FIG. 1.

While nozzles of the type of the '124 patent have been used with drag bits as shown in FIG. 2, they are not directly translatable to a rotary cone bit without the disadvantages discussed above. Therefore, a need exists for a nozzle and retainer assembly that allows for an increase in the size of the internal passage of a mini-extended nozzle so that the teachings of the '124 patent can be used in a mini-extended design for a range of nozzle orifice sizes comparable to that of conventional mini-extended nozzles.

One teaching of the '124 is the generation of lower than hydrostatic pressure zones on the hole bottom. In drilling applications, fluid is transmitted to the hole bottom via a drill string to remove cuttings from the hole bottom and transport them back to the surface through the annular space between the drill string and the hole wall. Weighting materials are typically added to the drilling fluid to ensure the bore hole pressure is greater than that of the pore pressure to ensure the integrity of the bore hole. If the fluid is under-weighted, causing the bore pressure to be less than the pore pressure of the surrounding formation, the hole can cave in and stick the drill string in the hole which causes costly hole deviations. However, if the hole pressure is too high, rock bit penetration rates are significantly reduced since the chips generated by the cutters tend to be held in the formation by the pressure differential across the hole surfaces. The '124 nozzles are intended to generate localized low pressure zones on the hole bottom which allows cuttings to lift from the hole bottom in these localized zones in the presence of global overburden pressures. To generate the localized low pressure zones, the '124 nozzles are intended to generate lobes of flow which move the fluid radially outboard from the centerline of the nozzle. Because the flow from the '124 nozzles is not axisymmetric like that of nozzle 10 in FIG. 1, a need exists to optimize the rotational position of the nozzles relative to the cones of a rotary cone bit.

Additionally, nozzles may have passages and/or asymmetric orifices that direct the fluid at an angle. As fluid flows through an angled passage, it will impart a rotational force on the nozzle. Such nozzles must be able to be readily located at a desired rotational orientation and/or locked against rotational forces from fluid flow through the bit. Thus a need exists for a nozzle and retainer assembly that allows for an increase in the size of the internal passageway of a mini-extended nozzle and provide for rotational location and/or locking of the nozzle relative to the bit body.

SUMMARY OF THE INVENTION

One aspect of the present invention provides a novel nozzle and retainer assembly that moves the engagement point between the nozzle and retainer radially outward to allow for additional cross-sectional area of the nozzle which in turn allows for a larger internal passage. In this aspect, a rotary cone earth boring bit is provided that comprises a bit body assembly with at least one rotary cone rotatably mounted on the bit body assembly. The bit body assembly defines at least one fluid bore therethrough and a generally cylindrical receptacle in communication with the fluid bore. The receptacle has an interior end defining a seat shoulder, an open end opposite thereto, and a generally cylindrical inside surface. A nozzle has a first end abutted against the seat shoulder of the receptacle and a second end opposite thereto. The nozzle has an outer surface with a stepped portion extending radially outward so as to define a first nozzle shoulder spaced from and facing toward the seat shoulder and a second nozzle shoulder facing opposite thereto. The nozzle defines a passage therethrough having a first end in communication with the fluid bore and a second end opposite thereto defining an orifice at the second end of the nozzle. A retainer sleeve is concentrically disposed about the outer surface of the nozzle and has an outside surface removably attached to the inside surface of the receptacle. The retainer sleeve has a first end engaged with the engagement shoulder of the rib so as to retain the nozzle in the receptacle and a second end opposite thereto toward the open end of the receptacle. An annular seal is located between the seat shoulder of the receptacle and the gland shoulder of the rib of the nozzle.

In another aspect of the present invention, a rotary cone earth boring bit is provided that comprises a bit body assembly with at least one rotary cone rotatably mounted on the bit body assembly. The bit body assembly defines at least one fluid bore therethrough and a generally cylindrical receptacle in communication with the fluid bore. The receptacle has an interior end defining a seat shoulder, an open end opposite thereto, and a generally cylindrical inside surface. A nozzle has a first end abutted against the seat shoulder of the receptacle and a second end opposite thereto extending beyond the open end of the receptacle. The nozzle defines a passage therethrough having a first end in communication with the fluid bore and an orifice end opposite thereto at the second end of the nozzle. The passage has a first cross-sectional area at the first end, a second cross-sectional area at a point axially coextensive with the open end of the receptacle and a third cross-sectional area at the orifice end. The second cross-sectional area is at least about 25% of the first cross-sectional area. The passage converges from the second cross-sectional area to the third cross-sectional area. A retainer removably engages the inside surface of the receptacle and the nozzle to retain the nozzle in the receptacle. The retainer engages the nozzle at a point that is between the seat shoulder and the open end of the receptacle.

In another aspect of the present invention, a rotary cone earth boring bit is provided that comprises a bit body assembly with at least one rotary cone rotatably mounted on the bit body assembly with the cone having a cone axis and a cone surface extending from a nose toward the center of the bit body to a gage side opposite thereto. The cone surface has a plurality of cutting elements extending therefrom. The bit body assembly defines at least one fluid bore therethrough and a generally cylindrical receptacle in communication with the fluid bore. The receptacle has an interior end defining a seat shoulder, an open end opposite thereto, and a generally cylindrical inside surface. A nozzle has a first end abutted against the seat shoulder of the receptacle and a second end opposite thereto extending beyond the open end of the receptacle. The nozzle defines a passage therethrough having a first end in communication with the fluid bore and an orifice end opposite thereto at the second end of the nozzle. The internal passage has an inside surface and the inside surface towards the second end of the nozzle defines at least one flute therein that slopes in a flute direction toward the center of the nozzle as it approaches the second end of the nozzle. A retainer removably engages the inside surface of the receptacle and the nozzle to retain the nozzle in the receptacle. The retainer engages the nozzle at a point that is between the seat shoulder and the open end of the receptacle.

In another aspect of the present invention, a nozzle is provided that comprises a body with a generally cylindrical outer surface having a center axis and defining a longitudinal direction from a first end to a second end opposite thereto. The body defines a passage therethrough from the first end to the second end of the nozzle. The outer surface defines a stepped portion located near the first end of the nozzle and extending radially outward and having a first nozzle shoulder spaced longitudinally from the first end and facing in the longitudinal direction toward the first end and a second nozzle shoulder opposite thereto facing in the longitudinal direction toward the second end. The outer surface of the nozzle at all points other than the stepped portion is radially inward of the stepped portion.

In another aspect of the present invention, a rotary cone earth boring bit is provided that comprises a bit body assembly and at least one rotary cone rotatably mounted on the bit body assembly. The cone has a rotational axis and an outer surface with a plurality of cutting elements extending therefrom. The bit body assembly defines at least one fluid bore therethrough and a generally cylindrical receptacle in communication with the fluid bore. The receptacle has an interior end defining a seat shoulder, an open end opposite thereto, and a generally cylindrical inside surface. A nozzle has a first end abutted against the seat shoulder of the receptacle and a second end opposite thereto. The nozzle defines a passage therethrough having a first end in communication with the fluid bore and an orifice end opposite thereto at the second end of the nozzle. The passage has an inside surface that, towards the second end of the nozzle, defines three or fewer flutes therein. Each flute slopes in a flute direction toward the center of the nozzle as it approaches the second end of the nozzle. The flute is directed between about 70 degrees to about 160 degrees or between about 200 degrees to about 290 degrees from the radially outermost point of the receptacle in a clockwise direction.

In another aspect of the present invention, a rotary cone earth boring bit is provided that comprises a bit body assembly and at least one rotary cone rotatably mounted on the bit body assembly. The cone has a rotational axis and an outer surface with a plurality of cutting elements extending therefrom. The bit body assembly defines at least one fluid bore therethrough and a generally cylindrical receptacle in communication with the fluid bore. The receptacle has an interior end defining a seat shoulder, an open end opposite thereto, and a generally cylindrical inside surface. A nozzle has a first end abutted against the seat shoulder of the receptacle and a second end opposite thereto. The nozzle defines a passage therethrough having a first end in communication with the fluid bore and an orifice end opposite thereto at the second end of the nozzle. The passage has an inside surface that, towards the second end of the nozzle, defines a single flute therein. The flute slopes in a flute direction toward the center of the nozzle as it approaches the second end of the nozzle. The flute is directed between about 60 degrees and about 300 degrees from the radially outermost point of the receptacle in a clockwise direction

DETAILED DESCRIPTION OF THE PREFERRED EMBODIMENT

Figure 3:
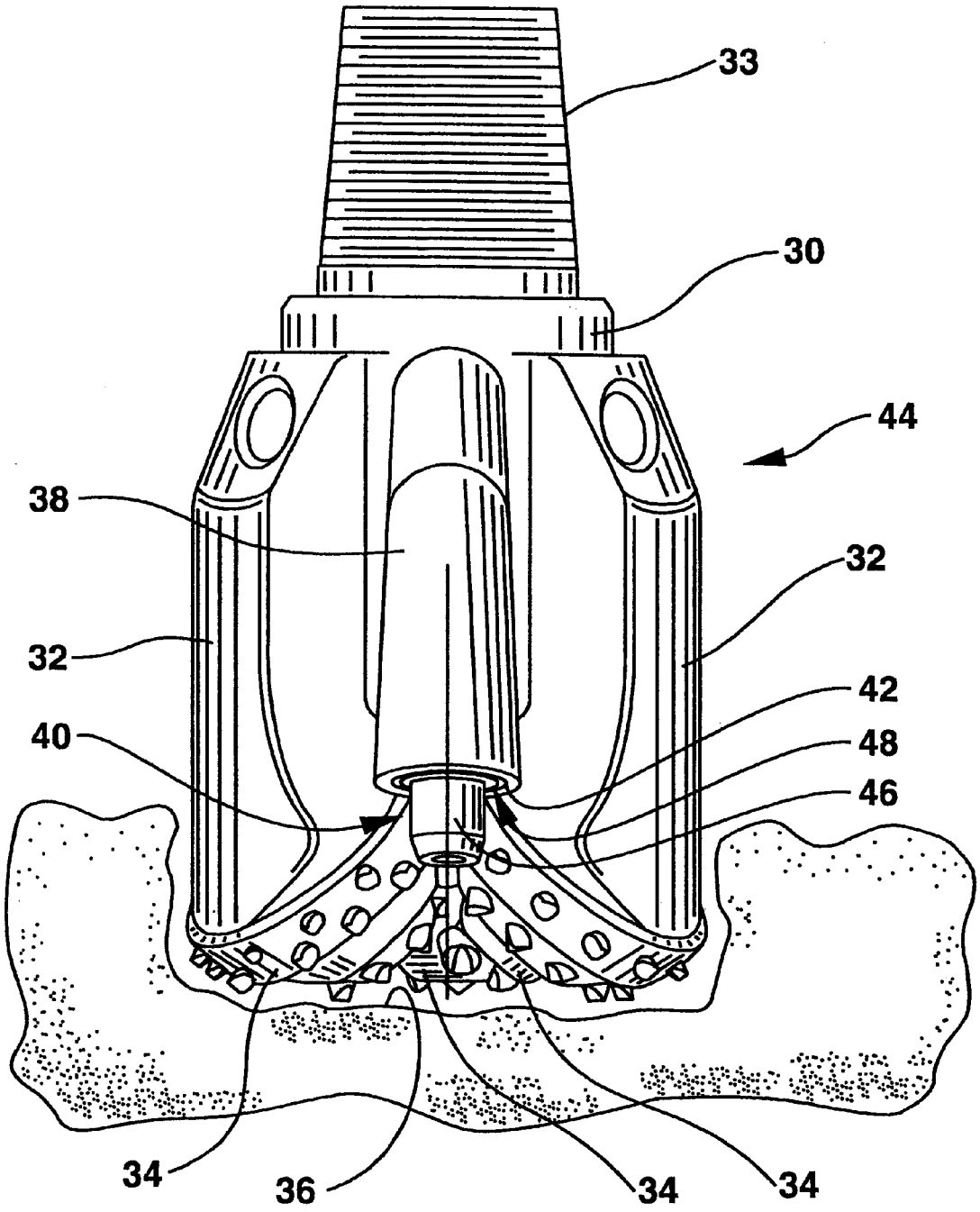
FIG. 3 is a side view of a bit according to the present invention.
Figure 4:
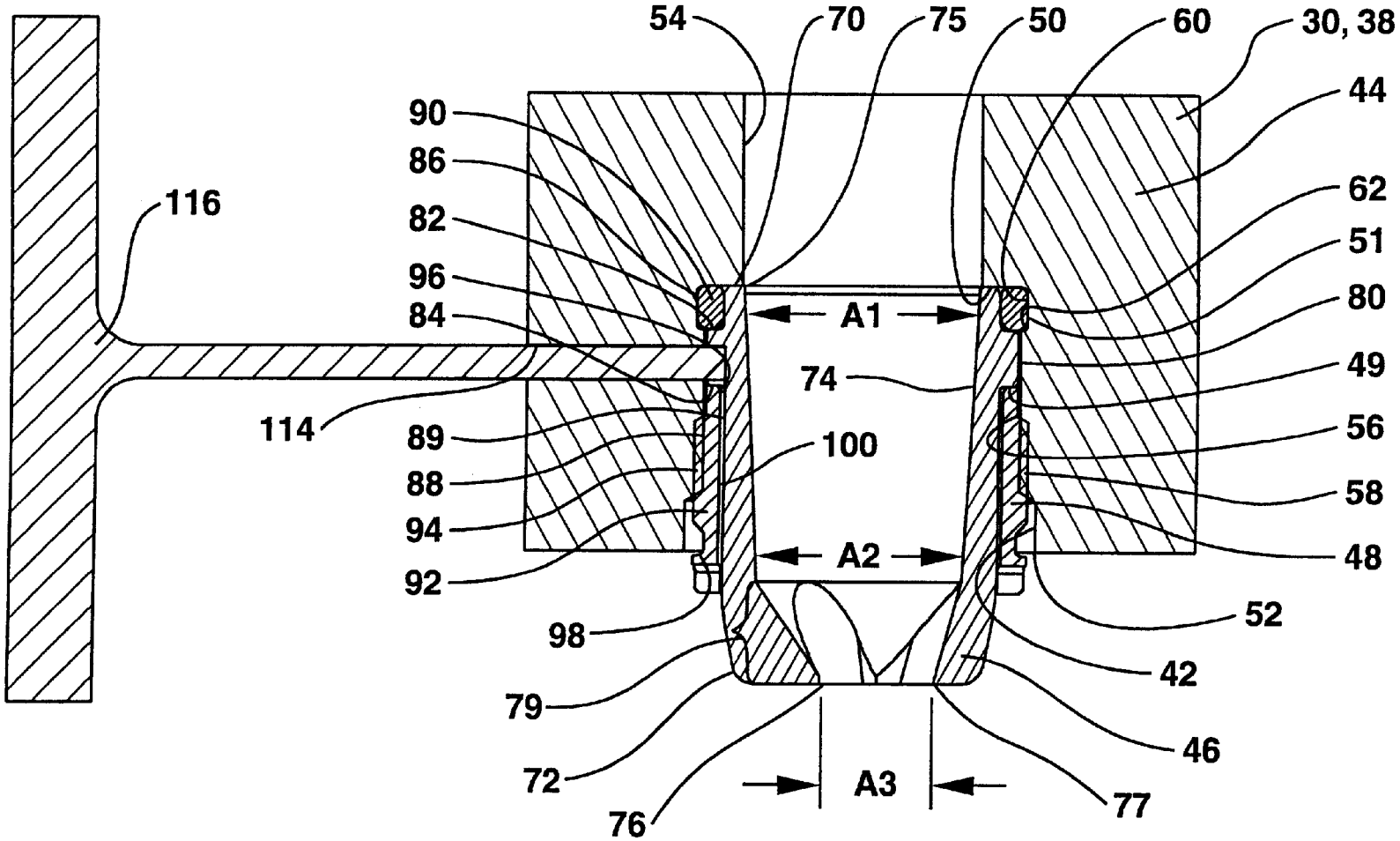
FIG. 4 is a cross-section of the preferred embodiment of the nozzle and retainer assembly of the present invention mounted in a bit and shown with orientation tool.
Figure 5:
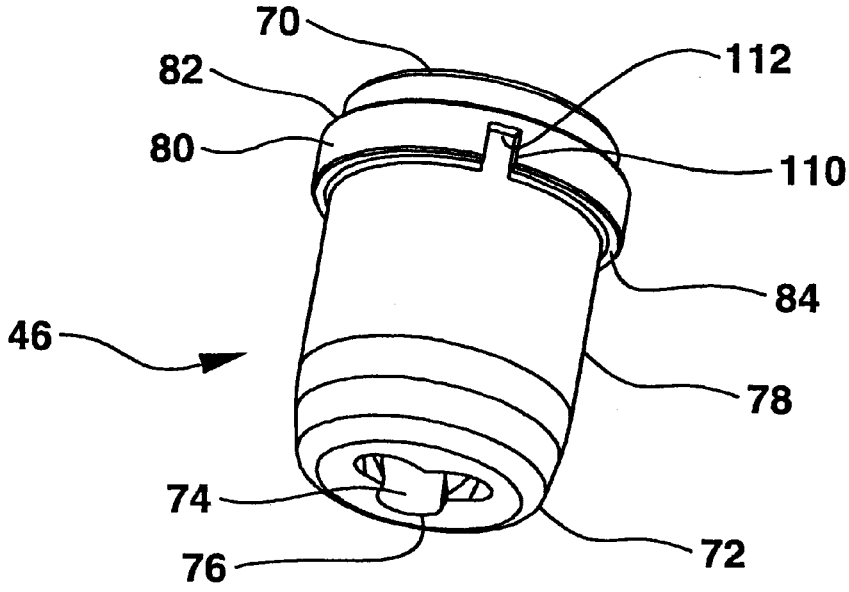
FIG. 5 is a perspective view of the nozzle of FIG. 4.

With reference to FIGS. 3–5, the preferred embodiment of the present invention is shown. FIG. 3 shows bit 44 of the present invention with bit body assembly 30 having legs 32 extending downward and threaded end 33 opposite thereto for attachment to a drill string. Rotary cones 34 are rotatably mounted to bit body assembly 30 as is known in the art for contacting borehole bottom 36. Nozzle and retainer assembly 40 is mounted in receptacle 42 of bit body assembly 30. Bit body assembly 30 also has boss 38 extending radially outward to locate receptacle 42 radially outward and axially toward borehole bottom 36. Nozzle 46 is captured in receptacle 42 by retainer 48 which is removably mounted within receptacle 42 to engage nozzle 46 at engagement point 49. As can be seen, by virtue of rotary cones 34 engaging borehole bottom 36, bit body assembly 30 is disposed above borehole bottom 36 in contrast to a drag bit where the bit body directly engages the borehole bottom.

One aspect of this embodiment of the present invention involves moving engagement point 49 between retainer 48 and nozzle 46 radially outward to allow more space for internal passage 74 as may be required by nozzles of the type disclosed in U.S. Pat. Nos. 5,494,124; 5,632,349; and 5,653,298. These patents are incorporated herein by reference. These types of nozzles require a larger internal passage relative to conventional nozzles to achieve comparable nozzle sizes. The present invention provides more space for larger internal passages in the nozzle to allow them to be used with a comparable range of nozzle sizes as conventional nozzles while still allowing them to be mounted in standard nozzle receptacles in the bit body.

Receptacle 42 is located in bit body assembly 30. Receptacle 42 can be located in bit body assembly 30 by many methods. Examples of these methods include machining receptacle 42, welding in a pre-machined sleeve such as that disclosed in U.S. Pat. No. 5,538,093 or by attaching a tube such as that disclosed in U.S. Pat. No. 5,669,459 that moves receptacle 42 closer to borehole bottom 36. Any of these methods of installation would provide a nozzle receptacle 42 that by definition is considered a part of bit body assembly 30 for purposes of this invention. Receptacle 42 extends from interior end 51 defining seat shoulder 50 to open end 52 and is in communication with fluid bore 54 of bit 44. Receptacle 42 is generally cylindrical with inside surface 56. At least a portion of inside surface 56 defines receptacle threads 58. Inside surface 56 also defines annular seal groove 60 at interior end 51 with gland shoulder 62 facing shoulder 50.

Nozzle 46 is at least partially disposed in receptacle 42. Nozzle 46 has first end 70 abutted against shoulder 50 and second end 72 extending beyond open end 52 of receptacle 42. Nozzle 46 has internal passage 74 that extends through nozzle 46 from first end 70 to second end 72. Internal passage 74 is in communication with fluid bore 54 and exits second end 72 at orifice 76. Nozzle 46 has outer surface 78 of which a substantial portion is generally cylindrical. Outer surface 78 defines stepped portion 80 extending radially outward to define first nozzle shoulder 82 facing and disposed from shoulder 50 and second nozzle shoulder 84 facing generally opposite first nozzle shoulder 82. First nozzle shoulder 82 is preferably at generally the same axial location as gland shoulder 62 so that annular gland 86 is defined between shoulder 50 as one side and first nozzle shoulder 82 and gland shoulder 62 together as the other side.

Seal 90 is located in annular gland 86. Seal 90 can be either a circumferential seal, a face seal, or a combination of both. A circumferential type seal is preferred although a variety of suitable seals are know in the art. A standard o-ring seal as is known in the art is preferred.

In FIG. 4, nozzle 46 is held in the receptacle 42 by retainer 48. In this embodiment, retainer 48 has first portion 88 that is removably attached to inside surface 56 of receptacle 42 and second portion 89 that positively engages second nozzle shoulder 84 to capture nozzle 46 in receptacle 42. More particularly, retainer sleeve 48 is shown as sleeve 92 that is generally cylindrical with external threads 94 that engage nozzle receptacle threads 58. Sleeve 92 has first end 96 abutting against second nozzle shoulder 84. Sleeve 92 has second end 98 opposite first end 96 that is adapted for receiving a wrench (not shown) for turning sleeve 92. Sleeve 92 has inside surface 100 that is generally cylindrical and having a diameter sufficiently larger than outer surface 78 of nozzle 46 such that sleeve 92 can be readily rotated relative to nozzle 46.

Figure 1:
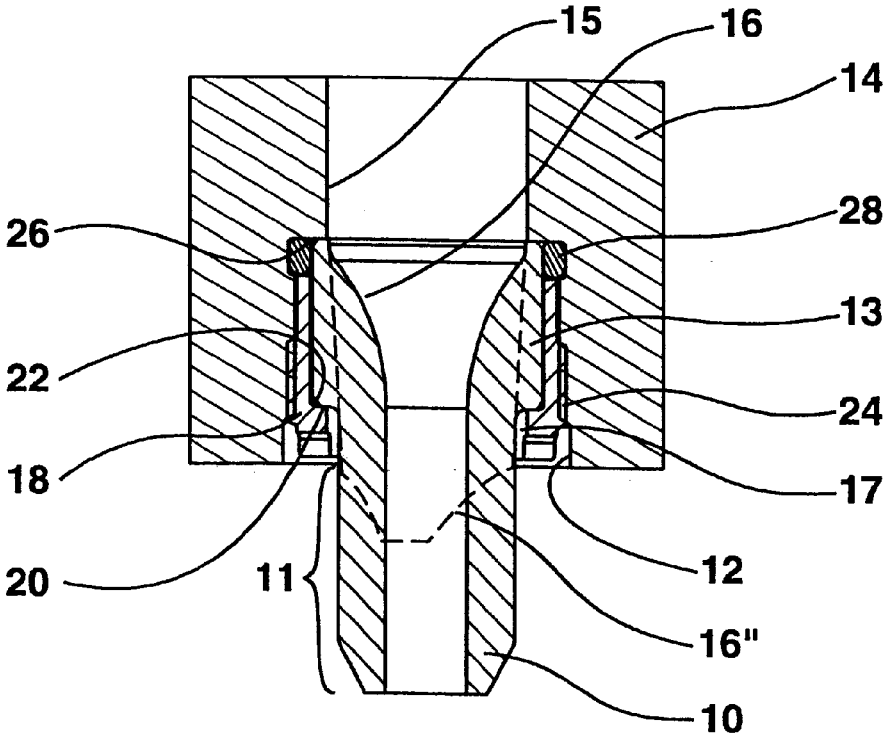
FIG. 1 (Prior Art)
FIG. 1 is a cross-section of a prior art mini-extended nozzle and retainer assembly mounted in a bit.
Figure 6:
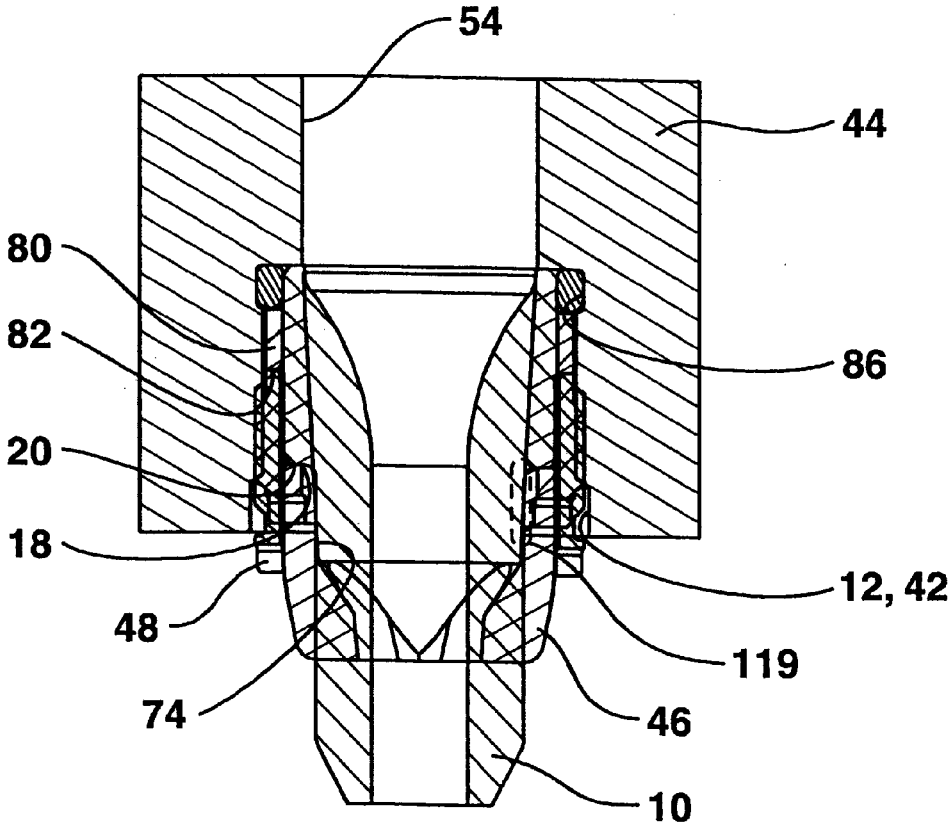
FIG. 6 is an overlay of the nozzle of FIG. 4 with the nozzle of FIG. 1 comparing the two nozzles in the same size receptacle in a bit.

The advantage of the present invention can be seen with reference to FIG. 6 which shows nozzle 46 of FIG. 4 overlaid with conventional mini-extended nozzle 10 of FIG. 1. As can be seen, stepped portion 80 provides first nozzle shoulder 82 radially outward compared to shoulder 20 of conventional nozzle 10 of FIG. 1. Additionally, stepped portion 80 locates first nozzle shoulder 82 under retainer 48 and stepped portion 80 completes seal gland 86. In contrast, shoulder 20 of conventional nozzle 10 of FIG. 1 is radially inward and retainer 18 is used to complete the seal gland. As can be seen, receptacles 12, 42 of the two Figures overlaid in FIG. 6 are the same size yet nozzle 46 accommodates a larger internal passage 74 than that of nozzle 10. It can be seen that internal passage 74 of nozzle 46 would break through the side wall of conventional nozzle 10 at the zone indicated as 119.

Figure 2:
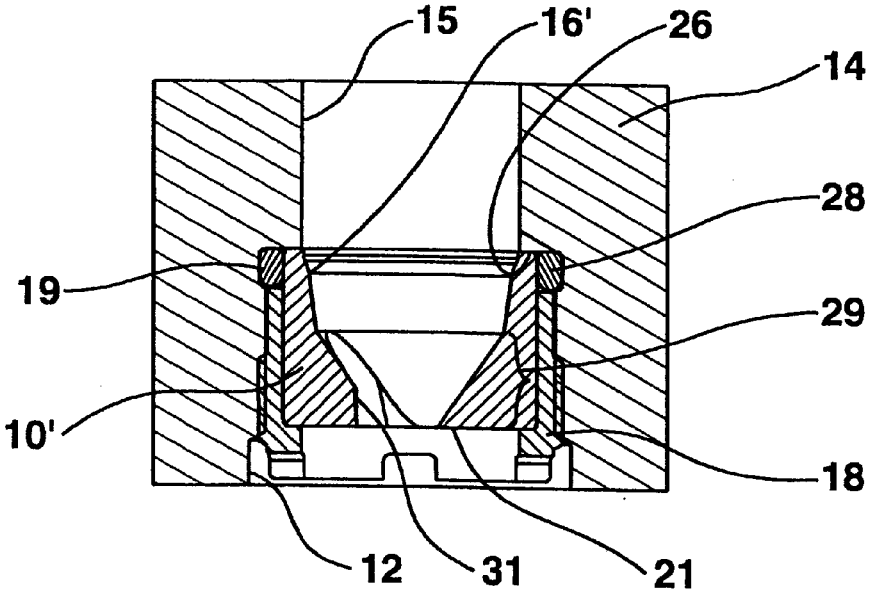
FIG. 2 (Prior Art)
FIG. 2 is a cross-section of a prior art nozzle and retainer assembly mounted in a bit.

With reference back to FIG. 4, internal passage 74 of nozzle 46 has first end 75 in communication with fluid bore 54 and second end 77 opposite thereto defining orifice 76 at second end 72 of nozzle 46. Internal passage 74 has first cross-sectional area A1 at first end 75, second cross-sectional area A2 at a point axially coextensive with open end 52 of receptacle 42, and third cross-sectional area A3 at orifice 76. Internal passage 74 converges from second cross-sectional area A2 to third cross-sectional area A3 defining transition zone 79. The portion of passage 74 extending from first cross-sectional area A1 to second cross-sectional area A2 may taper slightly radially inward toward second cross-sectional area A2 and it is preferred that A2 is at least about 25% of A1. It is further preferred that A2 is at least about 60% of A1. It is preferred that A3 be less than 75% of A2. A1 and A2 being relatively larger than A3 with a short transition zone 79 contributes to the hydraulic characteristics of nozzle 46. As can be seen, when transition zone 79 is kept the same length as transition zone 29 of FIG. 2 in the extended nozzle 46 of FIGS. 4–5, the cross-sectional area of passage 74 is larger relative to passage 16 of conventional mini-extended nozzle 10 of FIG. 1. And as shown in FIGS. 1 and 6, extended passage 16" would break through nozzle 10. Thus, the present invention provides additional cross-sectional area of nozzle 46 to allow for a larger cross-sectional area of internal passage 74 therethrough and particularly second cross-sectional area A2 of internal passage 74.

As an example, the outside diameter of the extended portion of nozzle 10 of FIG. 1 has a minor outside diameter of 0.945 inches and a cross-sectional area of 0.701 sq. in. The nozzle of the present invention allows the outer diameter of the nozzle to expand to 1.24 inches for a cross-sectional area of 1.208 sq. in. This is a 72% increase in cross sectional area of the nozzle to accommodate internal passage 74 therethrough.

With the lobed orifices of the '124 patent nozzles, the rotational position of nozzle 46 in receptacle 42 has an effect on the bit hydraulics because the fluid flow exiting from the orifice 76 is non-uniform. For example, with reference to FIGS. 7A and 7B, a tri-lobed orifice 76' is shown in nozzle 46. In this example, orifice 76' has three lobes 73*a, b,* and *c*. Internal passage 74 includes transition zone 79 as discussed above. Internal passage 74 has inside surface 71 that defines flutes 81*a, b* and *c* in transition zone 79 that correspond to lobes 73*a, b,* and *c*, respectively. Orifice 76' and transition zone 79 of this example are similar to the orifice and transition zone of FIGS. 3 and 4 of the '124 patent. Each flute 81*a, b* and *c* creates fluid flow in a direction represented by arrows 83*a, b* and *c*, respectively, in an angular direction towards centerline 85 of nozzle 46. This is similar to the slope of flute 81*a* which slopes toward the center of nozzle 46 as it approaches second end 72 of nozzle 46. Arrows 83*a, b,* and *c* in FIG. 7A will be used to indicate the direction of flutes 81*a, b,* and *c*, respectively in FIG. 7A.

The fluid flow exiting from flutes 81 is generally of a higher velocity than the surrounding fluid. If flute 81 is directed toward a portion of a cone 34, the higher velocity fluid flow from that flute 81 will pass in the proximity of the cone 34 and aid in cleaning cuttings from that portion of the cone. If cuttings are not cleaned from the cone, they may hydrate and adhere to the cone and portions of the cutting elements 37 thus preventing the full extent of the cutting elements from drilling the borehole bottom. Cleaning the cuttings from the cone prior to their hydration prevents adherence of the cuttings to the cone and improves the overall rate of penetration of the bit by allowing the full extent of cutting elements 37 to drill the borehole bottom. Furthermore, the low pressure zones created on the borehole bottom 36 that may be created by certain embodiments of nozzle 46 facilitate lifting of the cuttings in the presence of the borehole overburden pressure by reducing the pressure differential between the borehole pressure and the pore pressure.

Figure 7A:
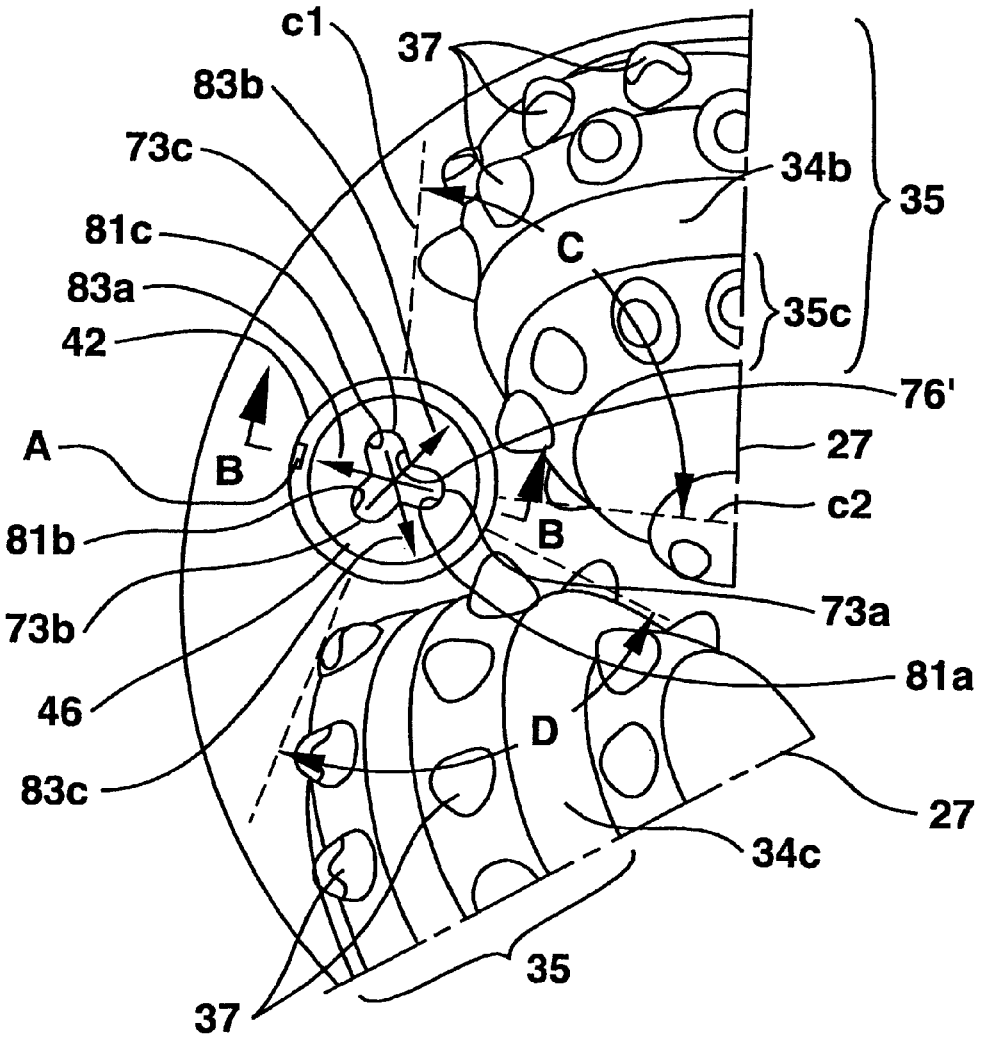
FIG. 7A is a partial bottom view of a bit according to an embodiment of the present invention.
Figure 7B:
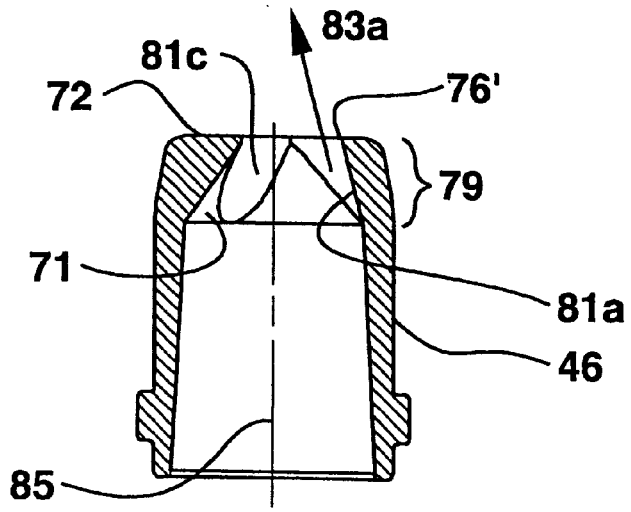
FIG. 7B is a cross-section of the nozzle of FIG. 7A along line B—B.

In FIG. 7A, flute 81*b* is directed toward the leading side of cone 34*b* to clean cuttings therefrom and flute 81*c* is directed toward the trailing side of cone 34*c* to clean cuttings therefrom. It is preferred that flutes 81*b* and *c* be directed toward the outer rows 35 of cutting elements 37 to aid in removing cuttings from around cutting elements 37. For purposes of assigning relative rotational positions of flutes 81, reference point A is located on bit body assembly 30 at the radially outermost point of receptacle 42 with angles proceeding clockwise therefrom. Thus, in the example of FIGS. 7A and 7B, arrow 83*a* from flute 81*a* is directed to 0 degrees, arrow 83*b* from 81*b* is directed to 120 degrees and arrow 83*c* from flute 81*c* is directed to 240 degrees. This example is a preferred rotational orientation of a tri-lobed orifice nozzle due to the dual cone cleaning by two of the flutes of the nozzle.

In an alternative of FIG. 7A, it may be desired to direct flute 81*b* at a different angle but still directed at the leading side of cone 34*b*. There is approximately a 90 degree range C of orientations, from about 70 degrees to about 160 degrees, for flute 81*b* to still be directed to the outer rows of the leading side of cone 34*b*. Range C extends from plane c1 through the center line of nozzle 46 and the radially outermost point of cone 34*b* with respect to cone axis 27 and plane c2 through the center line of nozzle 46 and a point on row 35*c* of cutting elements 37. When flute 83*b* is said to be directed within range C, it means that a plane bisecting flute 81*b* first intersects cone 34*b* at a point between plane c1 and plane c2. Similarly, flute 81*c* can be directed within approximately a 90 degree range D of about 200 degree to 290 degrees from reference point A in a clockwise direction to be directed to the outer rows of the trailing side of cone 34*c*. Range D extends similarly to range C but with respect to cone 34*c*. These ranges may fluctuate somewhat for different type bits depending on the location and orientation of receptacle 42 relative to cones 34.

Figure 8:
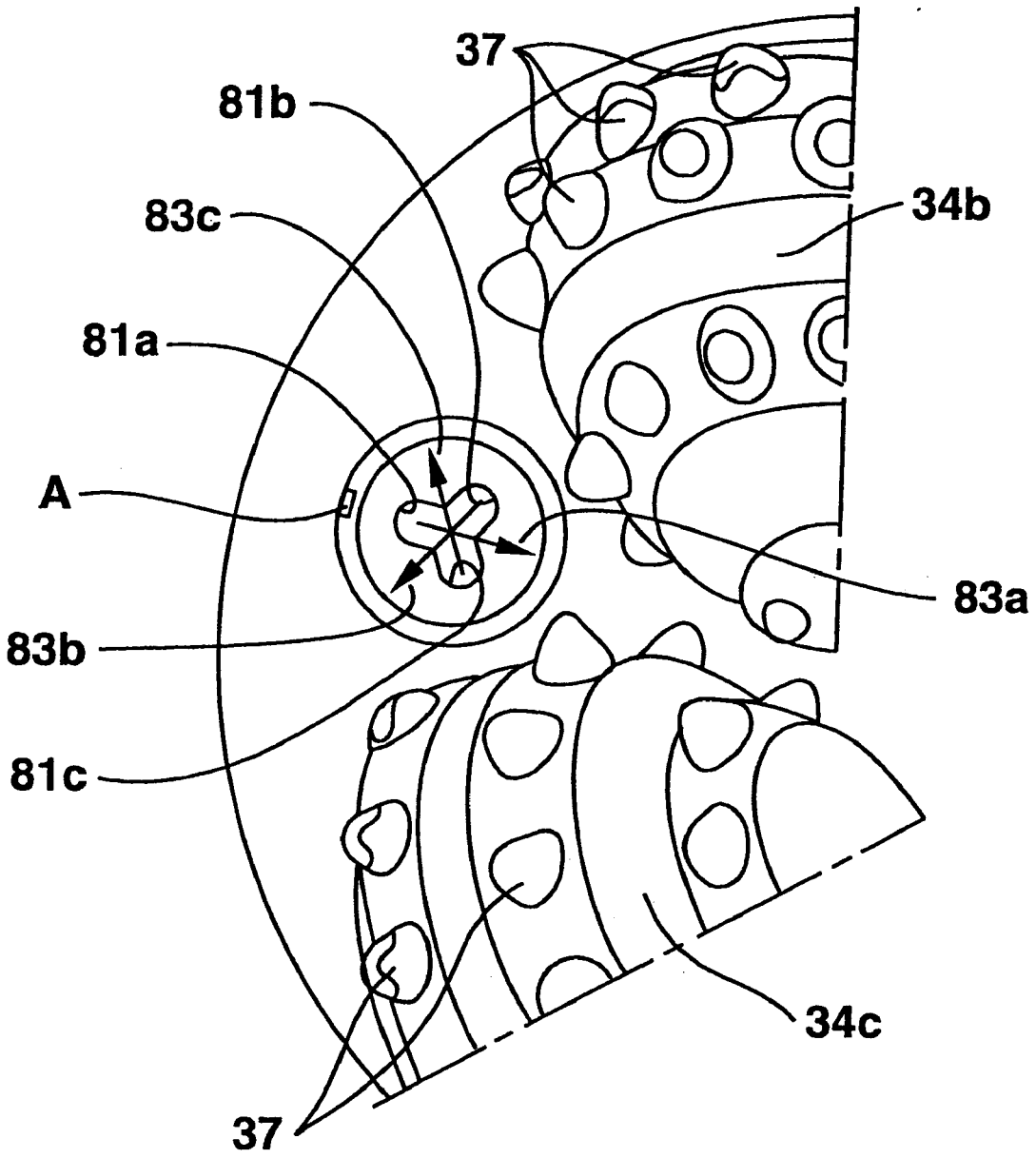
FIG. 8 is a partial bottom view of the bit of FIG. 7A with the nozzle in a different orientation.

FIG. 8 shows an alternative embodiment of a tri-lobed orifice nozzle where flute 81*a* is directed to the center of bit body assembly 30, or 180 degrees from reference point A, to clean cuttings from the center of the bit. Flute 81*a* may be within about 160 degrees to 200 degrees from reference point A in the clockwise direction to still be useful in cleaning in between cones 34*b* and 34*c*.

Figure 9A:
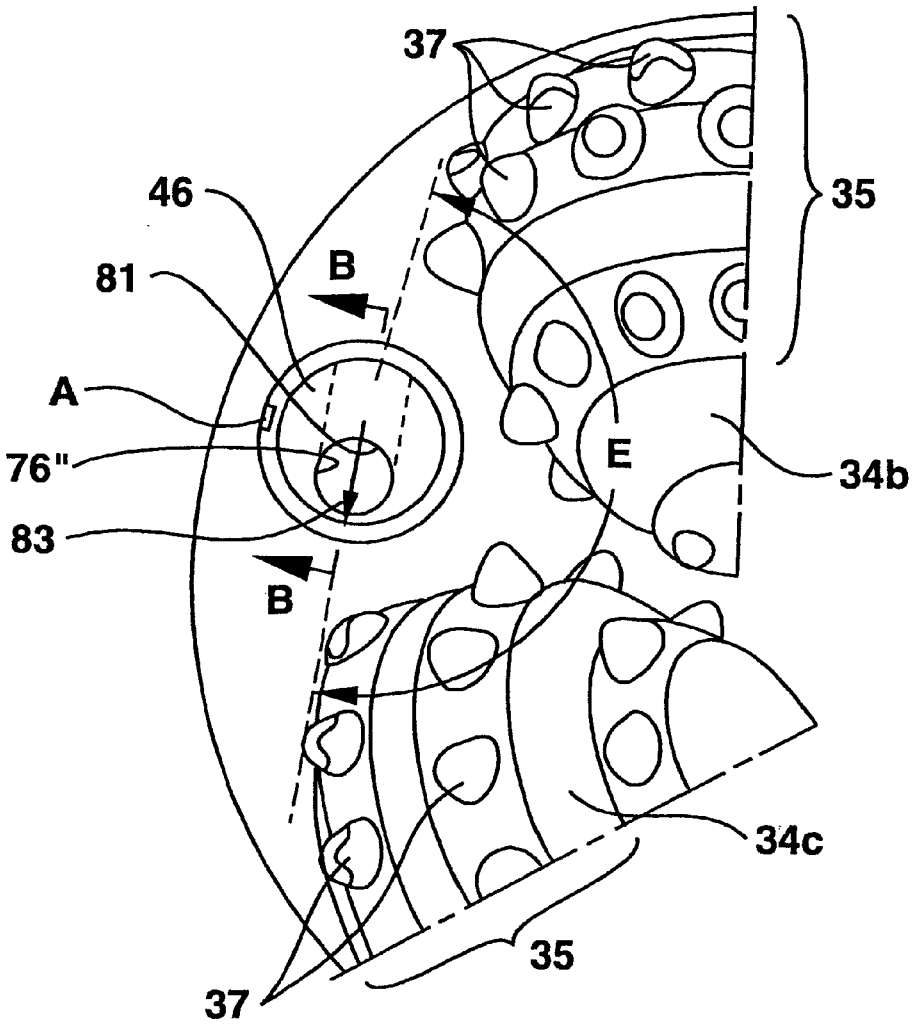
FIG. 9A is a partial bottom view of a bit according to another embodiment of the present invention.
Figure 9B:
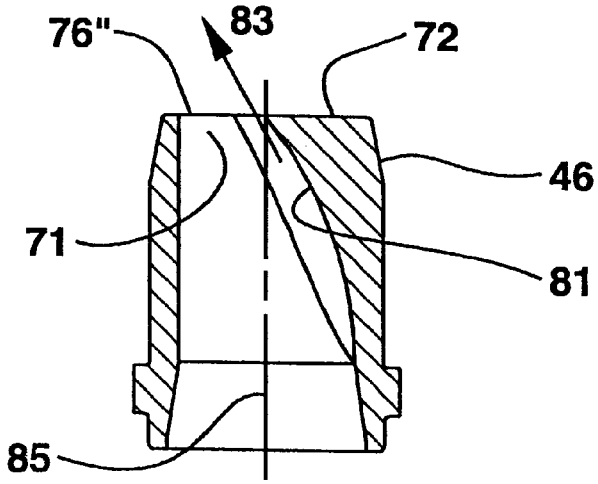
FIG. 9B is a cross-section of the nozzle of FIG. 9A along line B—B.

FIGS. 9A and 9B show another embodiment of nozzle 46 for use with the present invention. Nozzle 46 has round orifice 76". Internal passage 74 has inside surface 71 which defines only a single flute 81 which directs fluid in the direction represented by arrow 83. Flute 81 is preferably directed toward the outer rows 35 of inserts 37 on cone 34*b* or 34*c*, but can also be directed toward the center of the bit to increase bottom hole chip removal for the inner rows as shown by range E. Alternatively stated, flute 81 is preferably directed between about 60 degrees to about 300 degrees with respect to reference point A in the clockwise direction.

Figure 10:
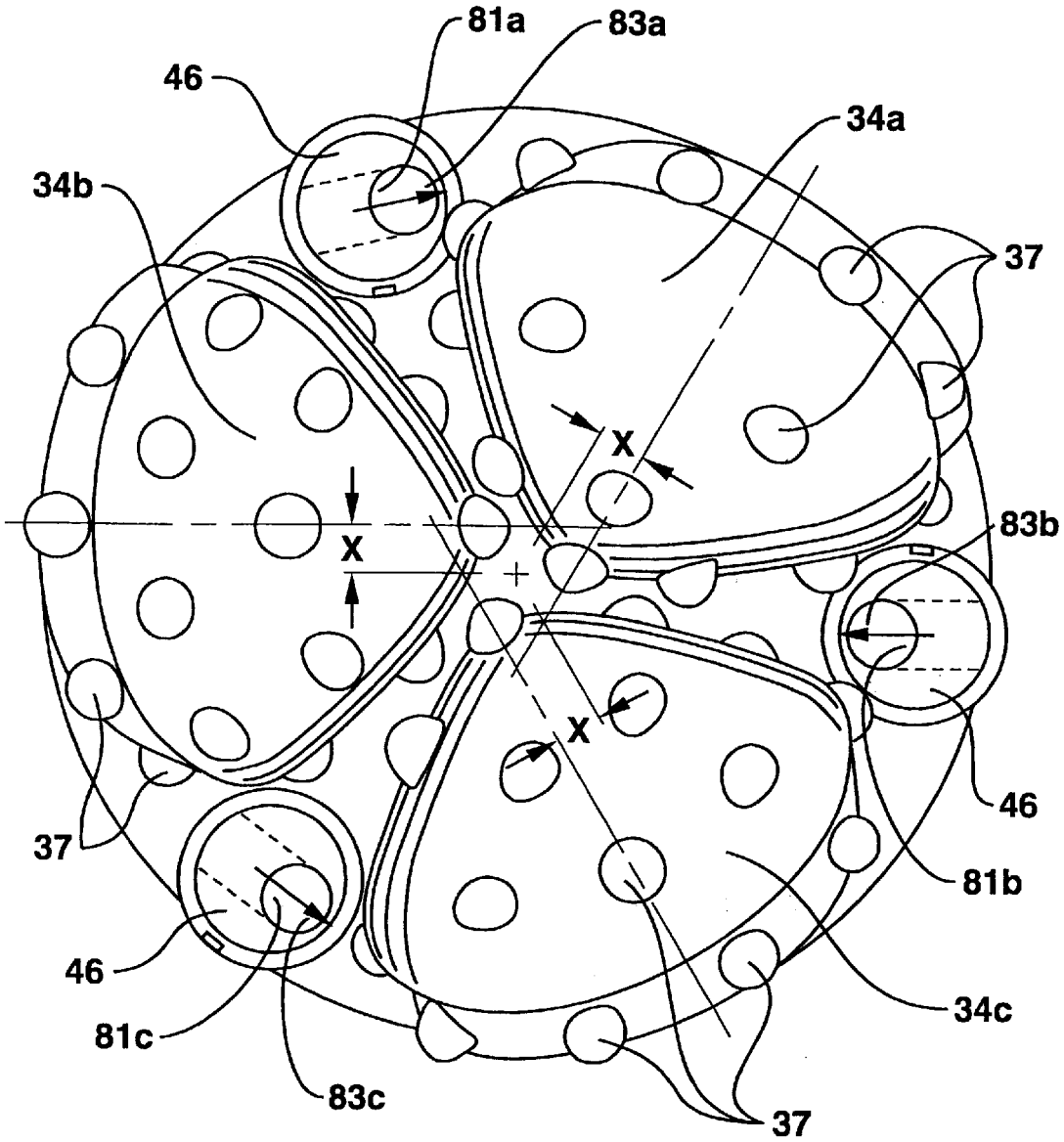
FIG. 10 is a bottom view of the bit of FIG. 9A with the nozzles in different orientations.

With reference to FIG. 10, a bit is shown with three nozzles 46 installed. Flute 81*a* is directed to the leading side of cone 34*a*, flute 81*b* directed to the center of the bit, and flute 81*c* is directed to the trailing side of 34*c*. FIG. 10 is just one representative pattern of orientation of three nozzles 46 in bit body assembly 30.

Figure 11A:
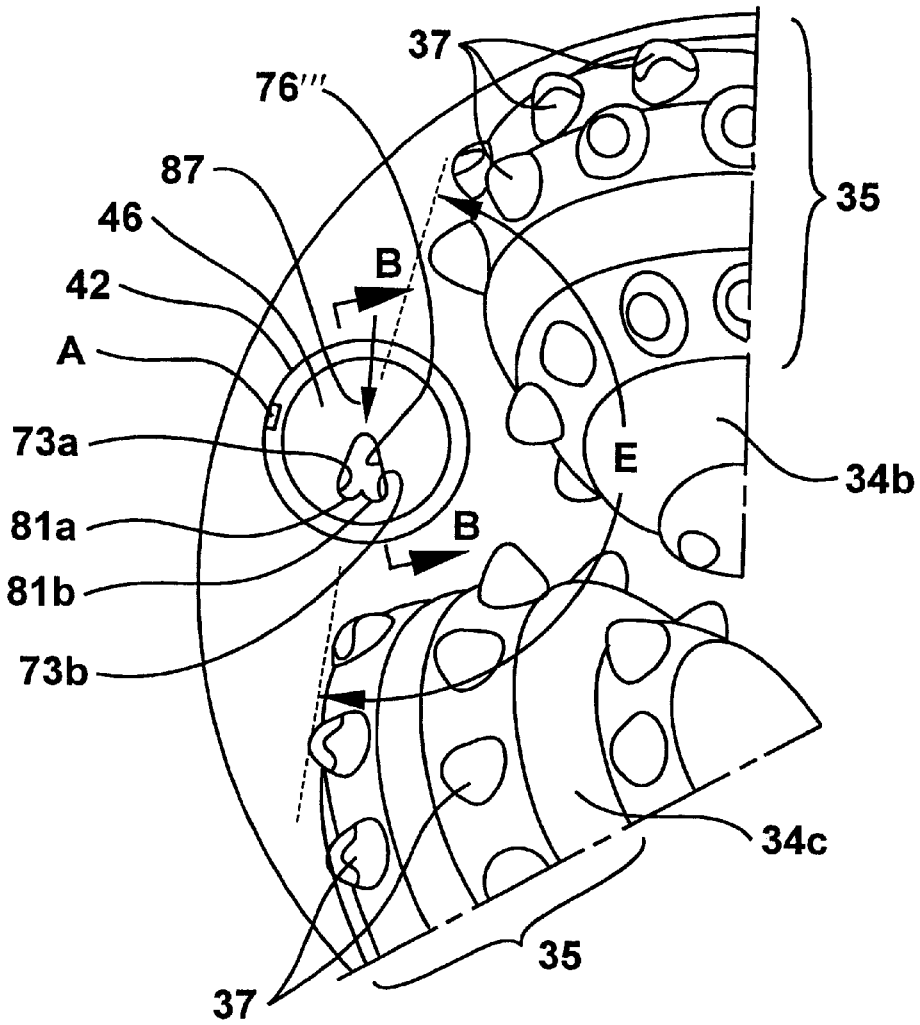
FIG. 11A is a partial bottom view of a bit according to another embodiment of the present invention.
Figure 11B:
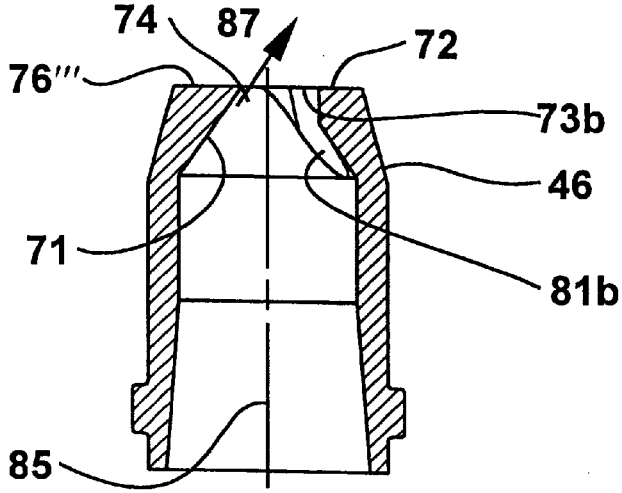
FIG. 11B is a cross-section of the nozzle of FIG. 11A along line B—B.

With reference to FIGS. 11A and 11B, another embodiment of nozzle 46 is shown with orifice 76"' being generally heart shaped. With this particular orifice, lobes 73*a* and *b* have corresponding flutes 81*a* and *b* defined in inside surface 71 of internal passage 74. However, the portion of orifice 76"' outside of the lobes is of sufficient cross-section that the predominant flow is from the non-lobe area of orifice 76"' represented by arrow 87. Orifice 76"' can be located such that arrow 87 is directed at outer rows 35 of cone 34*b* or 34*c* and/or within the angle ranges discussed above with regard to the single fluted nozzle shown in FIGS. 9A and 9B.

In view of the variation in desired rotational orientations of nozzle 46, it is preferred that nozzle 46 be capable of being variably rotationally located and locked relative to bit assembly 44 when non-axisymmetric orifice nozzles are used. The preferred means of rotationally locating nozzle 46 with respect to bit body assembly 30 can be seen with reference to FIGS. 4–5. Outer surface 78 of nozzle 46 is generally axisymmetric with the exception of orifice 76 (which may be non-axisymmetric as discussed above with regard to FIGS. 7–11) and key 110 that rotationally locates and/or locks nozzle 46 relative to receptacle 42. Key 110 is shown in FIG. 5 as notch 112 defined in stepped portion 80. Boss 38 of bit assembly 44 defines transverse port 114 that communicates with receptacle 42. Tool 116 is insertable into port 114 to align notch 112 with port 114. When it has been determined what the optimal orientation angle B is for a particular nozzle for a particular bit assembly, notch 112 is located relative to the shape of orifice 76 such that when notch 112 is aligned with port 114 in bit assembly 44, orifice 76 will be oriented as desired. In the preferred mode of assembly of nozzle and retainer assembly 40 of the present invention, seal 90 is inserted into seal groove 60. Nozzle 46 is placed in receptacle 42 and pushed in until first end 70 abuts against shoulder 50. Retainer 48 is then inserted into receptacle 42 and rotated to engage retainer threads 94 with receptacle threads 58. Nozzle 46 is rotationally located with tool 116. This is achieved by inserting tool 116 into port 114 and maintaining a slight insertion force on the tool while nozzle 46 is rotated back and forth to align notch 112 with port 114 at which time tool 116 will seat into notch 112 with a perceptible movement. While tool 116 is held seated in notch 112, retainer 48 is tightened with a wrench (not shown) that engages second end 98. Once retainer 48 is tightened, tool 116 is then removed. In this embodiment, tool 116 fixes the rotational position of nozzle 46 while retainer 48 is tightened.

It is likely that a particular nozzle 46 may have a different optimal orientation angle B for different bit types or different locations on the bit. For example, a tri-lobe orifice nozzle may be oriented in one receptacle such that a lobe is directed straight toward the side of the borehole and oriented in another receptacle such that one of the lobes is directed to clean one of the rotary cones. To accommodate the need to orient the same nozzle at different orientations, multiple keys 110 can be located about the circumference of stepped portion 80. Additional nozzle reference lines 103 can be placed on second end 72 of nozzle 46 to correspond to the circumferential location of the multiple keys and aid in rotational location of the nozzle as desired. For example, a nozzle could have a notch 112 located every 30 degrees around stepped portion 80. It should be understood that a variety of keys 110 can be used in addition to notch 112. However it is preferred that key 110 not disrupt first nozzle shoulder 82 so that it will provide a uniform surface to complete seal gland 86.

Figure 12:
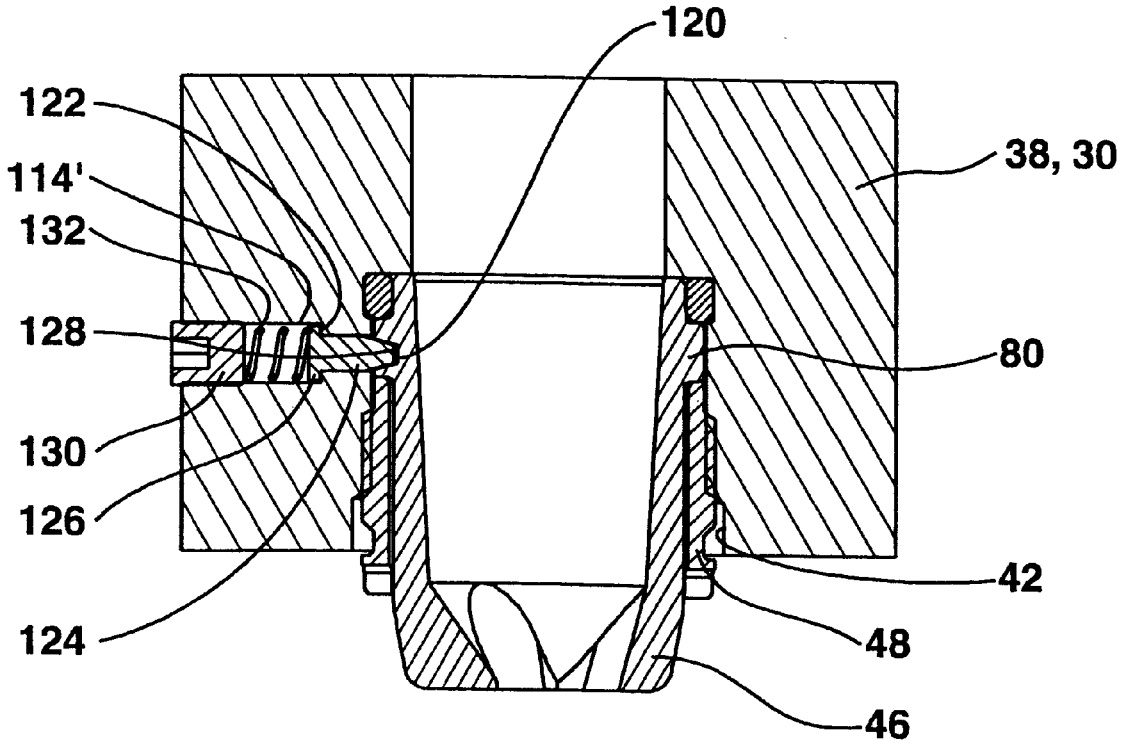
FIG. 12 is a cross-section of an alternative embodiment of the nozzle and retainer assembly of the present invention mounted in a bit.
Figure 13:
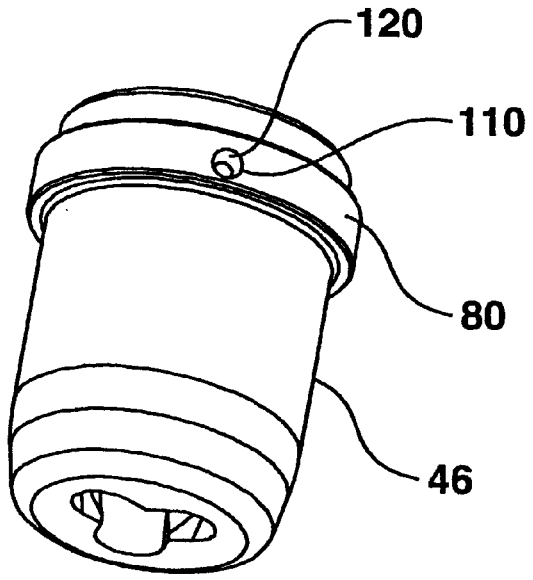
FIG. 13 is a perspective view of the nozzle of FIG. 12.
Figure 14:
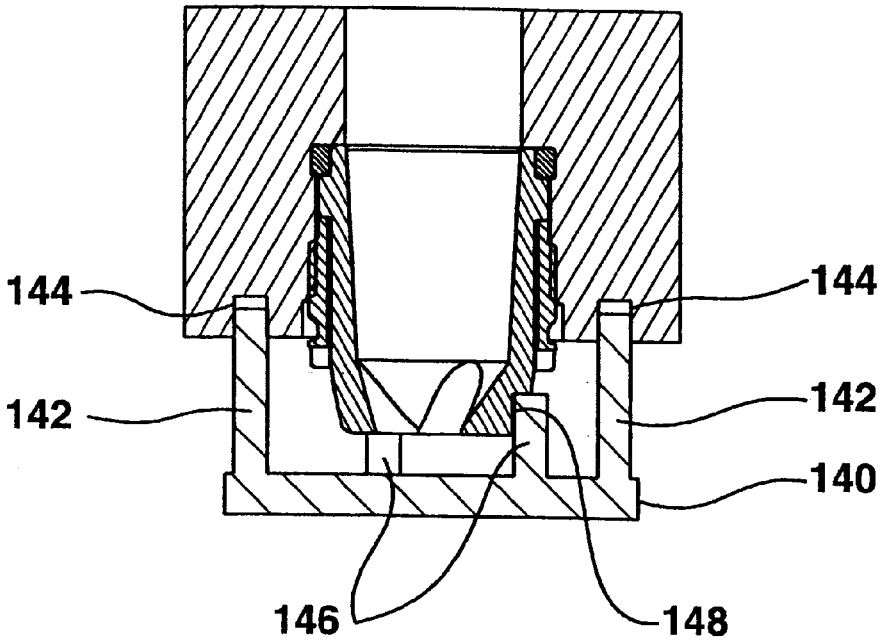
FIG. 14 is a cross-section of another alternative embodiment of the nozzle and retainer assembly of the present invention mounted in a bit and shown with an alternative orientation tool.

With reference to FIGS. 12 and 13, an alternative embodiment of the nozzle and retainer assembly of the present invention is shown which rotationally locates and continually rotationally locks nozzle 46 relative to bit assembly 44. In this embodiment, key 110 is shown as indentation 120. Boss 38 of bit body assembly 30 defines transverse port 114' which defines port shoulder 122. Pin 124 is slidably disposed within port 114' and has flange 126 that stops against port shoulder 122. Pin 124 has tip 128 that protrudes from port 114' into receptacle 42. Plug 130 is fixed at the exit of port 114' and spring 132 is disposed between plug 130 and flange 126 of pin 124 to bias pin 124 toward receptacle 42. In the preferred assembly of this embodiment, nozzle 46 is first located in receptacle 42. Pin 124, which is tapered at end 128, slides radially outboard as ledge 80 of nozzle 46 contacts pin end 128. Nozzle 46 is then rotated back and forth until indentation 120 aligns with port 114' at which time tip 128 of pin 124 will snap into indentation 120 by the force of spring 132. The positive engagement between tip 128 and indentation 120 rotationally locates and locks nozzle 46 while retainer 48 is then tightened. Additionally, tip 128 continues to rotationally lock nozzle 46 during operation should retainer 48 loosen or become unable to resist the rotational forces imparted on nozzle 46 by the fluid flow. To accommodate multiple orientation angles B, multiple indentations 120 can be circumferentially spaced about stepped portion 80. With reference to FIG. 14, another alternative embodiment of rotationally locating nozzle 46 relative to bit assembly 44 is shown. Template 140 has outer posts 142 that engage slots 144 on bit assembly 44 and inner posts 146 that engage slots 148 on nozzle 46. Alternatively, milled flats could be used in place of slots 148 on nozzle 46 or template 140 could be constructed to locate against leg 32 of bit assembly 44. Template 140 is used to hold nozzle 46 at the desired rotational position while retainer 48 is tightened. A wrench (not shown) is used to engage second end 98 of retainer 48 to tighten retainer 48 while nozzle 46 is held by template 140.

Figure 15A:
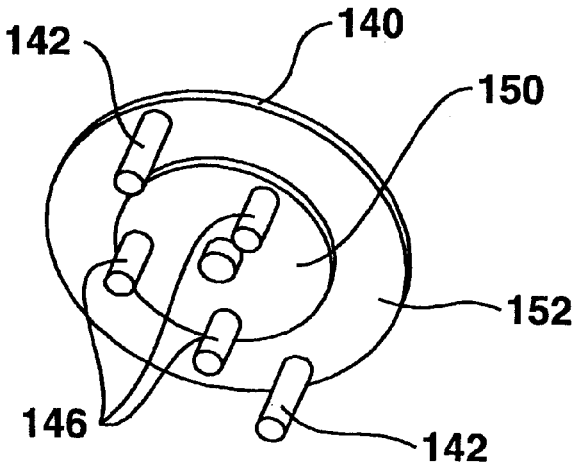
FIG. 15A is an under side perspective view of an alternative embodiment of an orientation tool that can be used with the assembly of FIG. 14.
Figure 15B:
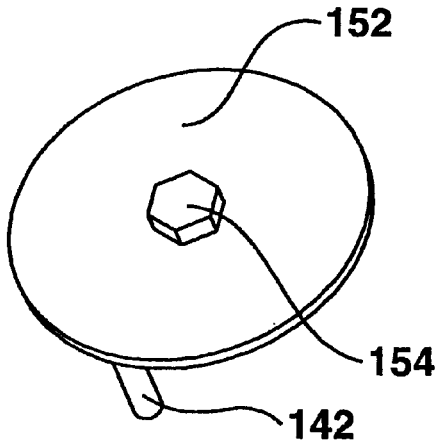
FIG. 15B is a top side perspective view of the orientation tool of FIG. 15A.

FIGS. 15A–B show an alternative embodiment of template 140 where inner posts 146 extend inner disk 150 that can be rotated relative to outer disk 152 from which outer posts 142 extend. With reference to FIG. 15B, inner disk 150 can have hex head 154 to be rotatable by a wrench. In this embodiment, nozzle can be oriented relative to bit assembly 44 at any desired rotational position by rotating inner disk 150 relative to outer disk 150. Once the desired position is reached, inner disk 150 is held in place while retainer 48 is tightened. The same nozzle may have a different optimal orientation angle B for different bit types and this embodiment allows variable orientation.

Figure 16A:
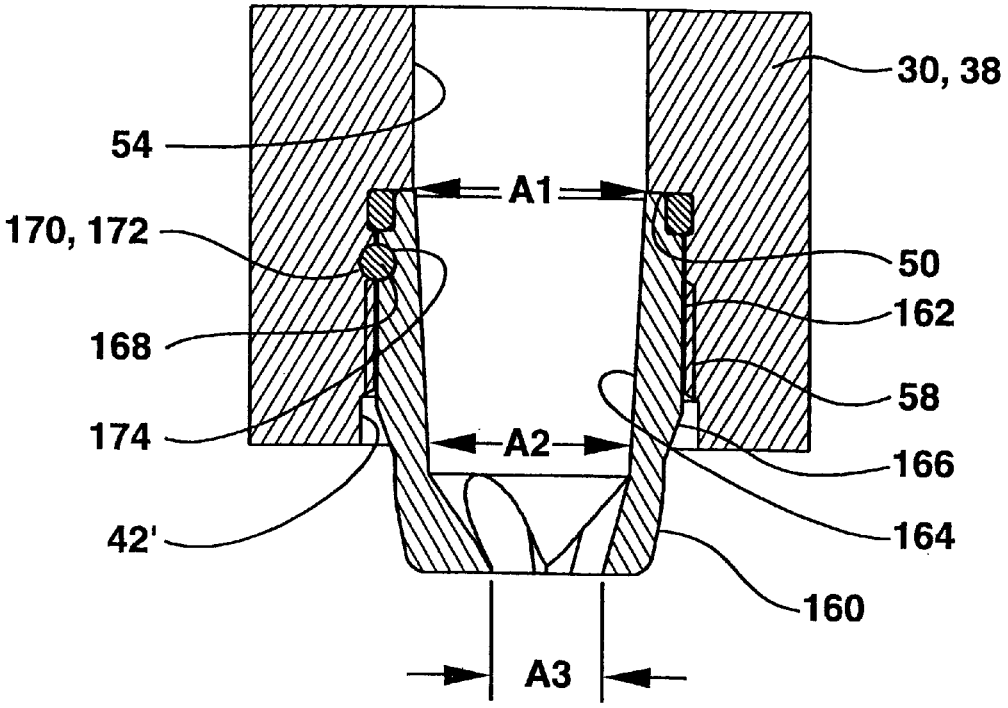
FIG. 16A is a cross-section of another alternative embodiment of the present invention mounted in a bit.
Figure 16B:
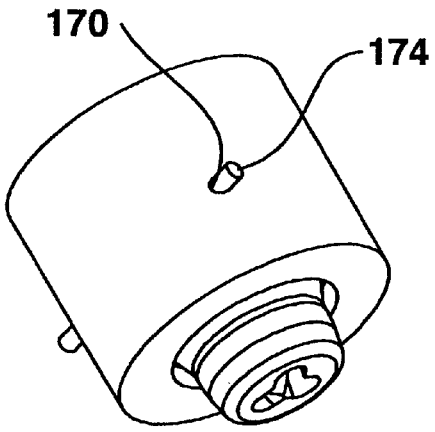
FIG. 16B is a perspective view of FIG. 16A.
Figure 16C:
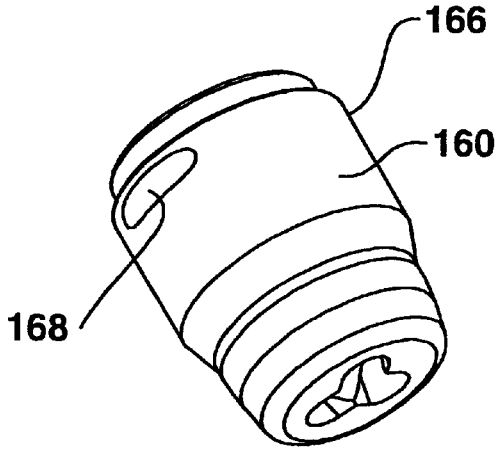
FIG. 16C is a perspective view of the nozzle of FIG. 16A.

With reference to FIGS. 16A–C, an alternative embodiment of the present invention is shown. In this embodiment, nozzle 160 has nozzle threads 162 that engage receptacle threads 58. By having nozzle 160 thread directly to receptacle threads 58 instead of interposing threaded sleeve 92 in the preferred embodiment, the maximum outer diameter of the nozzle is expanded thereby allowing a larger internal passage 164. Nozzle 160 has outer surface 166 that defines nozzle groove 168. In comparison with the preferred embodiment, it can be seen that nozzle 160 has been expanded into the area formerly occupied by threaded sleeve 92 and it is in the additional portion of nozzle 160 in which nozzle groove 168 is defined. Boss 38 defines port 170 that tangentially intersects receptacle 42 to define receptacle groove 172 opposite nozzle groove 168. Retainer 48 is shown as pin 174, which may be a nail, that can be driven into port 170 to engage nozzle groove 168 and receptacle groove 172 to rotationally locate and lock nozzle 160 relative to bit assembly 44. In the preferred assembly of this embodiment, nozzle 160 is threaded into receptacle 42. As nozzle 160 approaches shoulder 50 in receptacle 42, pin 174 is inserted into port 170 and an insertion force is maintained on pin 174 while nozzle 160 is rotated back and forth to align nozzle groove 168 with receptacle groove 172. Upon alignment, pin 174 will insert in between nozzle groove 168 and receptacle groove 172 to rotationally lock nozzle 160 relative to bit assembly 44. This positional locking mechanism could also be practiced on the embodiment of FIG. 5 by machining a groove in the stepped portion 80 that would match the receptacle port 170 and receptacle groove 172.

Figure 17:
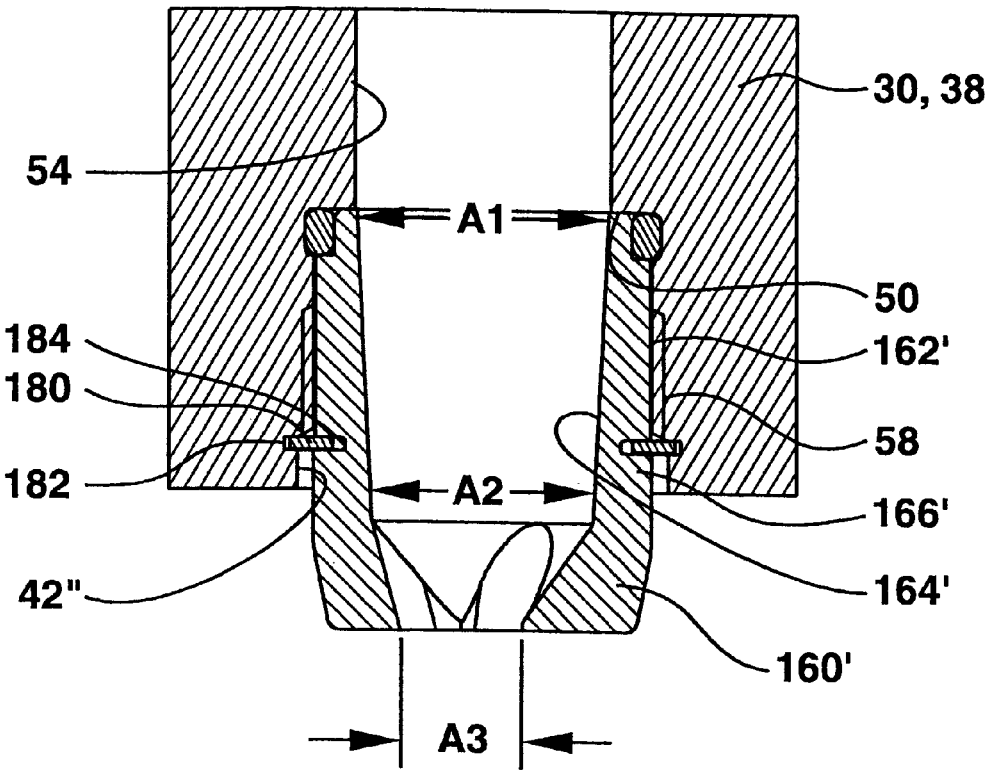
FIG. 17 is a cross-section of another alternative embodiment of the present invention mounted in a bit.
Figure 18:
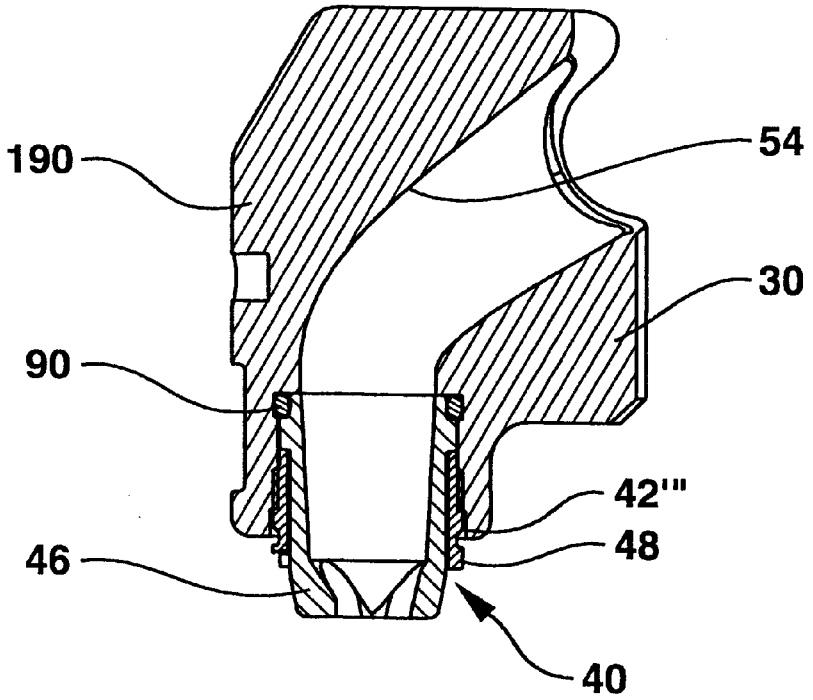
FIG. 18 is a cross-section of an alternative embodiment of a portion of the bit assembly of the present invention.

FIG. 17 shows an additional alternative embodiment where the outer diameter of nozzle 160' is increased like the nozzle of FIGS. 16A–C and outer surface 166' defines nozzle threads 162' to engage receptacle threads 58. Retainer 48 in this embodiment is c-shaped clip 180 that is removably inserted into receptacle groove 182 defined in receptacle 42" and nozzle groove 184 defined in outer surface 166' of nozzle 160' to retain nozzle 160' in receptacle 42". C-shaped clips or snap rings are a known way of retaining nozzles in bits. By expanding the diameter of nozzle 160' to engage receptacle 42 directly, additional space is provided for nozzle groove 184 to allow for larger internal passage 164'. This allows cross-sectional area A2 to be as large as needed to provide a desired range of flow rates for nozzles of the type of the '124 patent. With reference to FIG. 18, an alternative embodiment of bit 44 of the present invention is partially shown. In this embodiment, instead of being mounted in a boss as shown in FIG. 3, nozzle and retainer assembly 40 is mounted in retention body 190 of the type disclosed in U.S. Pat. No. 5,669,459, which is incorporated herein by reference. Retention body 190 is attached to bit body assembly, for example by welding, and provides a way to locate nozzle 46 closer to the borehole bottom while being robust enough to resist breakage often associated with extended nozzle tubes. Receptacle 42"' is of the same construction as receptacle 42 in boss 38 of FIG. 4.

Although the present invention has been described with respect to certain embodiments, various changes, substitutions and modifications may be suggested to one skilled in the art and it is intended that the present invention encompass such changes, substitutions and modifications as fall within the scope of the appended claims.

What is claimed is:

1. A rotary cone earth boring bit, comprising:

(a) a bit body assembly;

(b) at least one rotary cone rotatably mounted on the bit body assembly;

(c) the bit body assembly defining at least one fluid bore therethrough and a generally cylindrical receptacle in communication with the fluid bore, the receptacle having an interior end defining a seat shoulder, an open end opposite thereto, and a generally cylindrical inside surface;

(d) a nozzle having a first end abutted against the seat shoulder of the receptacle and a second end opposite thereto, the nozzle having an outer surface defining a stepped portion extending radially outward so as to define a first nozzle shoulder spaced from and facing toward the seat shoulder and a second nozzle shoulder facing opposite thereto, the nozzle defining a passage therethrough having a first end in communication with the fluid bore and a second end opposite thereto defining an orifice at the second end of the nozzle;

(e) a retainer sleeve concentrically disposed about the outer surface of the nozzle and having an outside surface removably attached to the inside surface of the receptacle, the retainer sleeve having a first end engaged with the second nozzle shoulder so as to retain the nozzle in the receptacle and a second end opposite thereto toward the open end of the receptacle no portion of the retainer sleeve extending beyond the second nozzle shoulder in a direction toward the seat shoulder.

2. The bit of claim 1 wherein the second end of the nozzle extends beyond the open end of the receptacle.

3. The bit of claim 2 wherein the passage has a first cross-sectional area at the first end, a second cross-sectional area at a point axially coextensive with the open end of the receptacle and a third cross-sectional area at the orifice, the second cross-sectional area at least about 25% of the first cross-sectional area, the passage converging from the second cross-sectional area to the third cross-sectional area.

4. The bit of claim 3 wherein the third cross-sectional area is less than about 75% of the second cross-sectional area.

5. The bit of claim 3 wherein the second cross-sectional area is at least about 60% of the first cross-sectional area.

6. The bit of claim 1 wherein the orifice is non-axisymmetric relative to the nozzle axis.

7. The bit of claim 6 wherein the nozzle is keyed to allow rotational location of the nozzle relative to the bit body assembly.

8. The bit of claim 7 wherein the nozzle is keyed by the stepped portion defining at least one notch therein and the bit body assembly defines a port with a first end in communication with the receptacle at the same axial extent as the notch such that the notch is locatable opposite the port.

9. The bit of claim 8 wherein the port has a second end opposite the first end that is in communication to the exterior of the bit such that a tool can be inserted into the port to engage the notch in the stepped portion.

10. The bit of claim 8 further comprising a pin slidably disposed within the port and biased to extend through the first end of the port to engage the notch in the stepped portion.

11. The bit of claim 7 wherein the second end of the nozzle defines at least one locating slot and the bit body assembly defines at least one reference slot such that the nozzle can be held at a desired rotational location relative to the bit body assembly during installation of the retainer sleeve in the receptacle.

12. The bit of claim 6 wherein the stepped portion of the nozzle has an outer circumferential surface that defines a nozzle groove and wherein the bit body assembly defines a port with one end in communication with the receptacle at the same axial extent as the nozzle groove, and wherein a pin is disposed through the port and in engagement with the nozzle groove the pin preventing rotational movement of the nozzle relative to the receptacle.

13. The bit of claim 1 wherein the nozzle is constructed of a wear-resistant material.

14. The bit of claim 13 wherein the wear resistant material is primarily tungsten carbide.

15. A rotary cone earth boring bit, comprising:

(a) a bit body assembly;

(b) at least one rotary cone rotatably mounted on the bit body assembly;

(c) the bit body assembly defining at least one fluid bore therethrough and a generally cylindrical receptacle in communication with the fluid bore, the receptacle having an interior end defining a seat shoulder, an open end opposite thereto, and a generally cylindrical inside surface;

(d) a nozzle having a first end abutted against the seat shoulder of the receptacle and a second end opposite thereto extending beyond the open end of the receptacle, the nozzle defining a passage therethrough having a first end in communication with the fluid bore and an orifice end opposite thereto at the second end of the nozzle, the passage having a first cross-sectional area at the first end, a second cross-sectional area at a point axially coextensive with the open end of the receptacle and a third cross-sectional area at the orifice end, the second cross-sectional area at least about 25% of the first cross-sectional area; the passage converging from the second cross-sectional area to the third cross-sectional area;

(e) a retainer removably engaging the inside surface of the receptacle and the nozzle to retain the nozzle in the receptacle, the retainer engaging the nozzle at a point that is between the seat shoulder and the open end of the receptacle.

16. The bit of claim 15 wherein the second cross-sectional area is at least about 60% of the first cross-sectional area.

17. The bit of claim 15 wherein the third cross-sectional area is less than about 75% of the second cross-sectional area.

18. The bit of claim 15 wherein the nozzle has an outer surface defining a circumferential stepped portion extending radially outward so as to define a first nozzle shoulder spaced from and facing toward the seat shoulder and a second nozzle shoulder facing opposite thereto.

19. The bit of claim 18 wherein the retainer is a sleeve concentrically disposed about the outer surface of the nozzle and having an outside surface removably attached to the inside surface of the receptacle, the sleeve having a first end engaged with the second nozzle shoulder of the stepped portion so as to retain the nozzle in the receptacle and a second end opposite thereto toward the open end of the receptacle.

20. The bit of claim 19 further comprising an annular seal located between the seat shoulder of the receptacle and the first nozzle shoulder of the stepped portion of the nozzle.

21. The bit of claim 18 wherein the orifice is non-axisymmetric relative to the nozzle axis.

22. The bit of claim 21 wherein the nozzle is keyed to allow rotational location of the nozzle relative to the bit body assembly.

23. The bit of claim 22 wherein the nozzle is keyed by the stepped portion defining at least one notch therein and the bit body assembly defines a port with a first end in communication with the receptacle at the same axial extend as the notch such that the notch is locatable opposite the port.

24. The bit of claim 23 wherein the port has a second end opposite that is in communication to the exterior of the bit such that a tool can be inserted into the port to engage the notch in the stepped portion.

25. The bit of claim 23 further comprising a pin slidably disposed within the port and biased to extend through the first end of the port to engage the notch in the stepped portion.

26. The bit of claim 15 wherein the second end of the nozzle defines at least one locating slot and the bit body assembly defines at least one reference slot such that the nozzle can be held at a desired rotational location relative to the bit body assembly during installation of the retainer in the receptacle.

27. The bit of claim 15 wherein the receptacle defines receptacle threads and the nozzle has an outer surface that defines nozzle threads threadedly engaged with the receptacle threads.

28. The bit of claim 27 wherein the retainer is located between the nozzle threads and the seat shoulder.

29. The bit of claim 28 wherein the outer surface of the nozzle at a point between the nozzle threads and the first end of the nozzle defines a nozzle groove and wherein the bit body assembly defines a port with one end in communication with the receptacle at the same axial extent as the nozzle groove, and wherein the retainer is a pin disposed through the port and in engagement with the nozzle groove.

30. The bit of claim 29 wherein the pin prevents rotational movement of the nozzle relative to the receptacle.

31. The bit of claim 27 wherein the retainer is located between the receptacle threads and the open end of the receptacle.

32. The bit of claim 31 wherein the outer surface of the nozzle defines a circumferential nozzle groove and the inside surface of the receptacle defines a circumferential receptacle groove at generally the same axial extent as the nozzle groove, and wherein the retainer is a C shaped clip removably disposed in the nozzle groove and receptacle groove to retain nozzle 46 in receptacle 42.

33. A nozzle comprising a body with a generally cylindrical outer surface having a center axis and defining a longitudinal direction from a first end to a second end opposite thereto, the body defining a passage therethrough from the first end to the second end of the nozzle, the outer surface defining a stepped portion located near the first end of the nozzle and extending radially outward and having a first nozzle shoulder spaced longitudinally from the first end and facing in the longitudinal direction toward the first end and a second nozzle shoulder opposite thereto facing in the longitudinal direction toward the second end, the outer surface of the nozzle at all points other than the stepped portion being radially inward of the stepped portion.

34. The nozzle of claim 33 wherein the passage defines an orifice at the second end and has a first cross-sectional area at the first end that tapers radially inward to a second cross-sectional area of at least 25% of the first cross-sectional area at a point beyond the longitudinal midpoint of the nozzle, the passage transitioning from the second cross-sectional area to the orifice with the orifice having a third cross-sectional area that is less than about 75% of the second cross-sectional area.

35. The nozzle of claim 33 wherein the nozzle is constructed of a wear-resistant material.

36. The nozzle of claim 35 wherein the wear resistant material is primarily tungsten carbide.

37. A rotary cone earth boring bit, comprising:

(a) a bit body assembly;

(b) at least one rotary cone rotatably mounted on the bit body assembly, the cone having a cone axis and a cone surface extending from a nose toward the center of the bit body to a gage side opposite thereto, the cone surface having a plurality of cutting elements extending therefrom;

(c) the bit body assembly defining at least one fluid bore therethrough and a generally cylindrical receptacle in communication with the fluid bore, the receptacle having an interior end defining a seat shoulder, an open end opposite thereto, and a generally cylindrical inside surface;

(d) a nozzle having a first end abutted against the seat shoulder of the receptacle and a second end opposite thereto extending beyond the open end of the receptacle, the nozzle defining a passage therethrough having a first end in communication with the fluid bore and an orifice end opposite thereto at the second end of the nozzle, the internal passage having an inside surface, the inside surface towards the second end of the nozzle defining at least one flute therein that slopes in a flute direction toward the center of the nozzle as it approaches the second end of the nozzle, and (e) a retainer removably engaging the inside surface of the receptacle and the nozzle to retain the nozzle in the receptacle, the retainer engaging the nozzle at a point that is between the seat shoulder and the open end of the receptacle, no portion of the retainer extending beyond the point of engagement in a direction toward the seat shoulder.

38. The bit of claim 37 wherein the flute is directed toward at least one of the cones.

39. The bit of claim 38 wherein a plane bisecting the flute and extending in the flute direction first intersects one of the cones at a point between the radially outermost point of the cone relative to the cone axis and about the midpoint of the cone surface.

40. The bit of claim 39 wherein the cutting elements are arranged around the cone surface in rows, and wherein the plane bisecting the flute first intersects one of the cutting elements at a point within the radially outermost two rows of cutting elements.

41. The bit of claim 37 wherein the flute is directed radially outward of the bit body assembly.

42. The bit of claim 37 wherein the flute is directed between about 70 degrees to about 160 degrees or between about 220 degrees to about 290 degrees from the radially outermost point of the receptacle in a clockwise direction.

43. The bit of claim 37 wherein the internal passage has more than one flute.

44. The bit of claim 37 wherein the orifice is round.

45. The bit of claim 37 wherein the orifice defines at least two lobes and the internal passage defines a flute corresponding to each lobe.

46. A rotary cone earth boring bit, comprising:

(a) a bit body assembly;

(b) at least one rotary cone rotatably mounted on the bit body assembly, the cone having a rotational axis and extending from a nose toward the center of the bit body to a gage side opposite thereto, the cone having an outer surface with a plurality of cutting elements extending therefrom;

(c) the bit body assembly defining at least one fluid bore therethrough and a generally cylindrical receptacle in communication with the fluid bore, the receptacle having an interior end defining a seat shoulder, an open end opposite thereto, and a generally cylindrical inside surface;

(d) a nozzle having a first end abutted against the seat shoulder of the receptacle and a second end opposite thereto, the nozzle defining a passage therethrough having a first end in communication with the fluid bore and an orifice end opposite thereto at the second end of the nozzle, the internal passage having an inside surface, the inside surface towards the second end of the nozzle defining three or fewer flutes therein, each flute sloping in a flute direction toward the center of the nozzle as it approaches the second end of the nozzle, the flute directed between about 70 degrees to about 160 degrees or between about 200 degrees to about 290 degrees from the radially outermost point of the receptacle relative to the center of the bit body in a clockwise direction.

47. The bit of claim 46 further comprising a retainer engaging the inside surface of the receptacle and the nozzle to retain the nozzle in the receptacle.

48. The bit of claim 47 wherein the retainer engages the nozzle at a point that is between the seat shoulder and the open end of the receptacle.

49. The bit of claim 46 wherein the second end of the nozzle extends beyond the open end of the receptacle.

50. The bit of claim 46 wherein the stepped portion of the nozzle has an outer circumferential surface that defines a nozzle groove and wherein the bit body assembly defines a port with one end in communication with the receptacle at the same axial extent as the nozzle groove, and wherein a pin is disposed through the port and in engagement with the nozzle groove such that the nozzle is rotationally locked relative to the receptacle.

51. A rotary cone earth boring bit, comprising:

(a) a bit body assembly;

(b) at least one rotary cone rotatably mounted on the bit body assembly, the cone having a rotational axis and extending from a nose toward the center of the bit body to a gage side opposite thereto, the cone having an outer surface with a plurality of cutting elements extending therefrom;

(c) the bit body assembly defining at least one fluid bore therethrough and a generally cylindrical receptacle in communication with the fluid bore, the receptacle having an interior end defining a seat shoulder, an open end opposite thereto, and a generally cylindrical inside surface;

(d) a nozzle having a first end abutted against the seat shoulder of the receptacle and a second end opposite thereto, the nozzle defining a passage therethrough having a first end in communication with the fluid bore and an orifice end opposite thereto at the second end of the nozzle, the internal passage having an inside surface, the inside surface towards the second end of the nozzle defining only one flute therein, the flute sloping in a flute direction toward the center of the nozzle as it approaches the second end of the nozzle, the flute directed between about 60 degrees to about 300 degrees from the radially outermost point of the receptacle from the center of the bit body in a clockwise direction.

52. The bit of claim 51 further comprising a retainer engaging the inside surface of the receptacle and the nozzle to retain the nozzle in the receptacle.

53. The bit of claim 52 wherein the retainer engages the nozzle at a point that is between the seat shoulder and the open end of the receptacle.

54. The bit of claim 51 wherein the second end of the nozzle extends beyond the open end of the receptacle.

* * * * *